US007350590B2

(12) United States Patent
Hosie et al.

(10) Patent No.: US 7,350,590 B2
(45) Date of Patent: Apr. 1, 2008

(54) INSTRUMENTATION FOR A DOWNHOLE DEPLOYMENT VALVE

(75) Inventors: David G. Hosie, Sugar Land, TX (US); Michael Brian Grayson, Sugar Land, TX (US); R. K. Bansal, Houston, TX (US)

(73) Assignee: Weatherford/Lamb, Inc., Houston, TX (US)

( * ) Notice: Subject to any disclaimer, the term of this patent is extended or adjusted under 35 U.S.C. 154(b) by 192 days.

(21) Appl. No.: 10/288,229

(22) Filed: Nov. 5, 2002

(65) Prior Publication Data

US 2004/0084189 A1 May 6, 2004

(51) Int. Cl.
*E21B 34/06* (2006.01)

(52) U.S. Cl. ..... 166/386; 166/66; 166/332.8; 166/250.01; 175/45

(58) Field of Classification Search ..... 166/386, 166/250.04, 373, 250.01, 276, 66, 332.8, 166/242.1, 255.1, 381, 285, 177.4; 175/40, 175/45

See application file for complete search history.

(56) References Cited

U.S. PATENT DOCUMENTS

| | | | | |
|---|---|---|---|---|
| 2,290,406 | A | 7/1942 | Crites | |
| 3,362,487 | A | 1/1968 | Lindsey | |
| 3,517,553 | A | 6/1970 | Williams et al. | |
| 3,552,502 | A | 1/1971 | Wilson, Sr. | |
| 3,831,138 | A | 8/1974 | Rammner | |
| 3,986,350 | A | 10/1976 | Schmidt | |
| 4,015,234 | A | 3/1977 | Krebs | |
| 4,160,970 | A | 7/1979 | Nicolson | |
| 4,247,312 | A | 1/1981 | Thakur et al. | |
| 4,297,880 | A | 11/1981 | Berger | |
| 4,367,794 | A * | 1/1983 | Bednar et al. | 166/66.5 |
| 4,440,239 | A | 4/1984 | Evans | |
| 4,553,428 | A | 11/1985 | Upchurch | |

(Continued)

FOREIGN PATENT DOCUMENTS

EP 0 945 590 A2 9/1999

(Continued)

OTHER PUBLICATIONS

Downhole Deployment Valve Bulletin, Weatherford International Ltd., (Online) Jan. 2003. Available from http://www.weatherford.com/weatherford/groups/public/documents/general/wft004406.pdf.

(Continued)

*Primary Examiner*—Kenneth Thompson
(74) *Attorney, Agent, or Firm*—Patterson & Sheridan, L.L.P.

(57) ABSTRACT

The present generally relates to apparatus and methods for instrumentation associated with a downhole deployment valve or a separate instrumentation sub. In one aspect, a DDV in a casing string is closed in order to isolate an upper section of a wellbore from a lower section. Thereafter, a pressure differential above and below the closed valve is measured by downhole instrumentation to facilitate the opening of the valve. In another aspect, the instrumentation in the DDV includes sensors placed above and below a flapper portion of the valve. The pressure differential is communicated to the surface of the well for use in determining what amount of pressurization is needed in the upper portion to safely and effectively open the valve. Additionally, instrumentation associated with the DDV can include pressure, temperature, and proximity sensors to facilitate the use of not only the DDV but also telemetry tools.

95 Claims, 6 Drawing Sheets

U.S. PATENT DOCUMENTS 4,630,675 A 12/1986 Neipling et al.
4,691,203 A 9/1987 Rubin et al.
4,775,009 A 10/1988 Wittrisch et al.
5,010,966 A 4/1991 Stokley et al.
5,014,781 A * 5/1991 Smith ..... 166/66.5
5,172,717 A 12/1992 Boyle et al.
5,235,285 A 8/1993 Clark et al.
5,293,551 A * 3/1994 Perkins et al. ..... 361/154
5,303,773 A 4/1994 Czernichow et al.
5,355,952 A 10/1994 Meynier
5,358,035 A * 10/1994 Grudzinski ..... 166/53
5,512,889 A 4/1996 Fletcher
5,661,402 A 8/1997 Chesnutt et al.
5,730,219 A * 3/1998 Tubel et al. ..... 166/250.1
5,857,522 A 1/1999 Bradfield et al.
5,892,860 A 4/1999 Maron et al.
5,900,137 A 5/1999 Homan
5,971,072 A 10/1999 Huber et al.
5,992,519 A * 11/1999 Ramakrishnan et al. ..... 166/250.15
5,996,687 A * 12/1999 Pringle et al. ..... 166/66.6
6,006,828 A 12/1999 Kluth et al.
6,006,832 A * 12/1999 Tubel et al. ..... 166/250.01
6,018,501 A 1/2000 Smith et al.
6,035,952 A 3/2000 Bradfield et al.
6,041,864 A 3/2000 Patel et al.
6,072,567 A 6/2000 Sapack
6,075,462 A * 6/2000 Smith ..... 340/854.6
6,095,250 A 8/2000 Day et al.
6,138,774 A 10/2000 Bourgoyne, Jr. et al.
6,173,772 B1 * 1/2001 Vaynshteyn ..... 166/250.15
6,176,312 B1 * 1/2001 Tubel et al. ..... 166/250.15
6,179,052 B1 1/2001 Purkis et al.
6,191,586 B1 * 2/2001 Bittar ..... 324/339
6,199,629 B1 * 3/2001 Shirk et al. ..... 166/66.4
6,209,663 B1 4/2001 Hosie ..... 175/57
6,234,258 B1 5/2001 Karigan
6,247,536 B1 6/2001 Leismer et al.
6,269,874 B1 * 8/2001 Rawson et al. ..... 166/53
6,279,660 B1 * 8/2001 Hay ..... 166/336
6,283,207 B1 * 9/2001 Lemetayer ..... 166/250.15
6,308,137 B1 10/2001 Underhill et al.
6,325,146 B1 12/2001 Ringgenberg et al.
6,328,118 B1 12/2001 Karigan et al.
6,343,649 B1 2/2002 Beck et al.
6,352,129 B1 3/2002 Best
6,354,147 B1 3/2002 Gysling et al.
6,374,925 B1 4/2002 Elkins et al.
6,386,288 B1 5/2002 Snider et al.
6,422,084 B1 7/2002 Fernald et al.
6,425,444 B1 7/2002 Metcalfe et al. ..... 166/387
6,427,776 B1 8/2002 Hoffman et al. ..... 166/311
6,429,784 B1 8/2002 Beique et al.
6,457,540 B2 10/2002 Gardes
6,478,091 B1 * 11/2002 Gano ..... 166/373
6,484,816 B1 11/2002 Koederitz
6,575,244 B2 6/2003 Chang et al.
6,585,041 B2 * 7/2003 Crossley ..... 166/53
6,598,675 B2 * 7/2003 Bussear et al. ..... 166/250.15
6,607,042 B2 8/2003 Hoyer et al.
6,644,110 B1 * 11/2003 Spriggs et al. ..... 73/152.51
6,668,943 B1 12/2003 Maus et al.
6,684,950 B2 * 2/2004 Patel ..... 166/250.01
6,755,261 B2 6/2004 Koederitz
6,814,142 B2 11/2004 Paulk et al.
6,851,481 B2 * 2/2005 Vinegar et al. ..... 166/374
6,904,981 B2 6/2005 van Riet
6,912,177 B2 * 6/2005 Smith ..... 367/82
6,920,942 B2 7/2005 Koederitz
6,951,252 B2 10/2005 Restarick et al.
6,966,373 B2 * 11/2005 Von Gynz-Rekowski..166/250.01
7,004,448 B2 2/2006 Suter et al.
7,044,237 B2 5/2006 Leuchtenberg
7,044,239 B2 5/2006 Pinckard et al.
2001/0048089 A1 * 12/2001 Clark et al. ..... 251/129.11
2003/0150621 A1 8/2003 Pia
2003/0155131 A1 8/2003 Vick, Jr.
2003/0192695 A1 * 10/2003 Dillenbeck et al. ..... 166/285
2004/0065446 A1 * 4/2004 Tran et al. ..... 166/384
2004/0139791 A1 7/2004 Johansen
2004/0178003 A1 9/2004 Riet
2004/0231889 A1 11/2004 van Riet
2004/0251032 A1 12/2004 Luke et al.
2005/0092523 A1 5/2005 McCaskill et al.
2005/0115708 A1 * 6/2005 Jabusch ..... 166/250.15
2006/0011236 A1 1/2006 Suter et al.
2006/0065402 A9 * 3/2006 Fontanan et al. ..... 166/358
2006/0086538 A1 4/2006 van Riet
2006/0124300 A1 6/2006 Steiner et al.
2006/0207795 A1 9/2006 Kinder et al.

FOREIGN PATENT DOCUMENTS

GB 2 154 632 9/1985
GB 2 299 915 A 10/1996
GB 2 330 598 4/1999
GB 2 335 453 9/1999
GB 2 360 532 A 8/2000
GB 2 381 282 4/2003
GB 2 394 242 4/2004
GB 2 394 974 5/2004
GB 2 400 125 10/2004
GB 2 403 250 12/2004
WO WO 98/50681 11/1998
WO WO 2004020774 A2 * 3/2004

OTHER PUBLICATIONS

Nimir Field In Oman Proves The Downhole Deployment Valve A Vital Technological Key To Success, Weatherford International Ltd., (online) 2003. Available at http://www.weatherford.com/weatherford/groups/public/documents/general/wft004337.pdf.
U.K. Search Report, Application No. GB 0325723.5, Dated Feb. 3, 2004.
U.K. Examination Report, Application No. GB 0325723.5, dated Jul. 6, 2005.
U.K. Search Report, Application No. GB0605764.0, dated May 17, 2006.
GB Examination and Search Report, Application No. 0619261.1 dated Jan. 17, 2007.
Norwegian Patent Application No. 2003 4919 Office Action dated Apr. 17, 2007.
Canadian Office Action, Application No. 2,448,419, dated Feb. 13, 2007.

* cited by examiner

INSTRUMENTATION FOR A DOWNHOLE DEPLOYMENT VALVE

BACKGROUND OF THE INVENTION

1. Field of the Invention

The present invention generally relates to methods and apparatus for use in oil and gas wellbores. More particularly, the invention relates to methods and apparatus for controlling the use of valves and other automated downhole tools through the use of instrumentation that can additionally be used as a relay to the surface. More particularly still, the invention relates to the use of deployment valves in wellbores in order to temporarily isolate an upper portion of the wellbore from a lower portion thereof.

2. Description of the Related Art

Oil and gas wells typically begin by drilling a borehole in the earth to some predetermined depth adjacent a hydrocarbon-bearing formation. After the borehole is drilled to a certain depth, steel tubing or casing is typically inserted in the borehole to form a wellbore and an annular area between the tubing and the earth is filed with cement. The tubing strengthens the borehole and the cement helps to isolate areas of the wellbore during hydrocarbon production.

Historically, wells are drilled in an "overbalanced" condition wherein the wellbore is filled with fluid or mud in order to prevent the inflow of hydrocarbons until the well is completed. The overbalanced condition prevents blow outs and keeps the well controlled. While drilling with weighted fluid provides a safe way to operate, there are disadvantages, like the expense of the mud and the damage to formations if the column of mud becomes so heavy that the mud enters the formations adjacent the wellbore. In order to avoid these problems and to encourage the inflow of hydrocarbons into the wellbore, underbalanced or near underbalanced drilling has become popular in certain instances. Underbalanced drilling involves the formation of a wellbore in a state wherein any wellbore fluid provides a pressure lower than the natural pressure of formation fluids. In these instances, the fluid is typically a gas, like nitrogen and its purpose is limited to carrying out drilling chips produced by a rotating drill bit. Since underbalanced well conditions can cause a blow out, they must be drilled through some type of pressure device like a rotating drilling head at the surface of the well to permit a tubular drill string to be rotated and lowered therethrough while retaining a pressure seal around the drill string. Even in overbalanced wells there is a need to prevent blow outs. In most every instance, wells are drilled through blow out preventers in case of a pressure surge.

As the formation and completion of an underbalanced or near underbalanced well continues, it is often necessary to insert a string of tools into the wellbore that cannot be inserted through a rotating drilling head or blow out preventer due to their shape and relatively large outer diameter. In these instances, a lubricator that consists of a tubular housing tall enough to hold the string of tools is installed in a vertical orientation at the top of a wellhead to provide a pressurizable temporary housing that avoids downhole pressures. By manipulating valves at the upper and lower end of the lubricator, the string of tools can be lowered into a live well while keeping the pressure within the well localized. Even a well in an overbalanced condition can benefit from the use of a lubricator when the string of tools will not fit though a blow out preventer. The use of lubricators is well known in the art and the forgoing method is more fully explained in U.S. patent application Ser. No. 09/536,937, filed Mar. 27, 2000, and that published application is incorporated by reference herein in its entirety.

While lubricators are effective in controlling pressure, some strings of tools are too long for use with a lubricator. For example, the vertical distance from a rig floor to the rig draw works is typically about ninety feet or is limited to that length of tubular string that is typically inserted into the well. If a string of tools is longer than ninety feet, there is not room between the rig floor and the draw works to accommodate a lubricator. In these instances, a down hole deployment valve or DDV can be used to create a pressurized housing for the string of tools. Downhole deployment valves are well known in the art and one such valve is described in U.S. Pat. No. 6,209,663, which is incorporated by reference herein in its entirety. Basically, a DDV is run into a well as part of a string of casing. The valve is initially in an open position with a flapper member in a position whereby the full bore of the casing is open to the flow of fluid and the passage of tubular strings and tools into and out of the wellbore. In the valve taught in the '663 patent, the valve includes an axially moveable sleeve that interferes with and retains the flapper in the open position. Additionally, a series of slots and pins permits the valve to be openable or closable with pressure but to then remain in that position without pressure continuously applied thereto. A control line runs from the DDV to the surface of the well and is typically hydraulically controlled. With the application of fluid pressure through the control line, the DDV can be made to close so that its flapper seats in a circular seat formed in the bore of the casing and blocks the flow of fluid through the casing. In this manner, a portion of the casing above the DDV is isolated from a lower portion of the casing below the DDV.

The DDV is used to install a string of tools in a wellbore as follows: When an operator wants to install the tool string, the DDV is closed via the control line by using hydraulic pressure to close the mechanical valve. Thereafter, with an upper portion of the wellbore isolated, a pressure in the upper portion is bled off to bring the pressure in the upper portion to a level approximately equal to one atmosphere. With the upper portion depressurized, the wellhead can be opened and the string of tools run into the upper portion from a surface of the well, typically on a string of tubulars. A rotating drilling head or other stripper like device is then sealed around the tubular string or movement through a blowout preventer can be re-established. In order to reopen the DDV, the upper portion of the wellbore must be repressurized in order to permit the downwardly opening flapper member to operate against the pressure therebelow. After the upper portion is pressurized to a predetermined level, the flapper can be opened and locked in place. Now the tool string is located in the pressurized wellbore.

Presently there is no instrumentation to know a pressure differential across the flapper when it is in the closed position. This information is vital for opening the flapper without applying excessive force. A rough estimate of pressure differential is obtained by calculating fluid pressure below the flapper from wellhead pressure and hydrostatic head of fluid above the flapper. Similarly when the hydraulic pressure is applied to the mandrel to move it one way or the other, there is no way to know the position of the mandrel at any time during that operation. Only when the mandrel reaches dead stop, its position is determined by rough measurement of the fluid emanating from the return line. This also indicates that the flapper is either fully opened or fully closed. The invention described here is intended to take out the uncertainty associated with the above measurements.

In addition to problems associated with the operation of DDVs, many prior art downhole measurement systems lack reliable data communication to and from control units located on a surface. For example, conventional measurement while drilling (MWD) tools utilize mud pulse, which works fine with incompressible drilling fluids such as a water-based or an oil-based mud, but they do not work when gasified fluids or gases are used in underbalanced drilling. An alternative to this is electromagnetic (EM) telemetry where communication between the MWD tool and the surface monitoring device is established via electromagnetic waves traveling through the formations surrounding the well. However, EM telemetry suffers from signal attenuation as it travels through layers of different types of formations. Any formation that produces more than minimal loss serves as an EM barrier. In particular salt domes tend to completely moderate the signal. Some of the techniques employed to alleviate this problem include running an electric wire inside the drill string from the EM tool up to a predetermined depth from where the signal can come to the surface via EM waves and placing multiple receivers and transmitters in the drill string to provide boost to the signal at frequent intervals. However, both of these techniques have their own problems and complexities. Currently, there is no available means to cost efficiently relay signals from a point within the well to the surface through a traditional control line.

Expandable Sand Screens (ESS) consist of a slotted steel tube, around which overlapping layers of filter membrane are attached. The membranes are protected with a pre-slotted steel shroud forming the outer wall. When deployed in the well, ESS looks like a three-layered pipe. Once it is situated in the well, it is expanded with a special tool to come in contact with the wellbore wall. The expander tool includes a body having at least two radially extending members, each of which has a roller that when coming into contact with an inner wall of the ESS, can expand the wall past its elastic limit. The expander tool operates with pressurized fluid delivered in a string of tubulars and is more completely disclosed in U.S. Pat. No. 6,425,444 and that patent is incorporated in its entirety herein by reference. In this manner ESS supports the wall against collapsing into the well, provides a large wellbore size for greater productivity, and allows free flow of hydrocarbons into the well while filtering out sand. The expansion tool contains rollers supported on pressure-actuated pistons. Fluid pressure in the tool determines how far the ESS is expanded. While too much expansion is bad for both the ESS and the well, too little expansion does not provide support to the wellbore wall. Therefore, monitoring and controlling fluid pressure in the expansion tool is very important. Presently fluid pressure is measured with a memory gage, which of course provides information after the job has been completed. A real time measurement is desirable so that fluid pressure can be adjusted during the operation of the tool if necessary.

There is a need therefore, for a downhole system of instrumentation and monitoring that can facilitate the operation of downhole tools. There is a further need for a system of instrumentation that can facilitate the operation of downhole deployment valves. There is yet a further need for downhole instrumentation apparatus and methods that include sensors to measure downhole conditions like pressure, temperature, and proximity in order to facilitate the efficient operation of the downhole tools. Finally, there exists a need for downhole instrumentation and circuitry to improve communication with existing expansion tools used with expandable sand screens and downhole measurement devices such as MWD and pressure while drilling (PWD) tools.

SUMMARY OF THE INVENTION

The present invention generally relates to methods and apparatus for instrumentation associated with a downhole deployment valve (DDV). In one aspect, a DDV in a casing string is closed in order to isolate an upper section of a wellbore from a lower section. Thereafter, a pressure differential above and below the closed valve is measured by downhole instrumentation to facilitate the opening of the valve. In another aspect, the instrumentation in the DDV includes different kinds of sensors placed in the DDV housing for measuring all important parameters for safe operation of the DDV, a circuitry for local processing of signal received from the sensors, and a transmitter for transmitting the data to a surface control unit.

In yet another aspect, the design of circuitry, selection of sensors, and data communication is not limited to use with and within downhole deployment valves. All aspects of downhole instrumentation can be varied and tailored for others applications such as improving communication between surface units and measurement while drilling (MWD) tools, pressure while drilling (PWD) tools, and expandable sand screens (ESS).

DETAILED DESCRIPTION OF A PREFERRED EMBODIMENT

Figure 1:
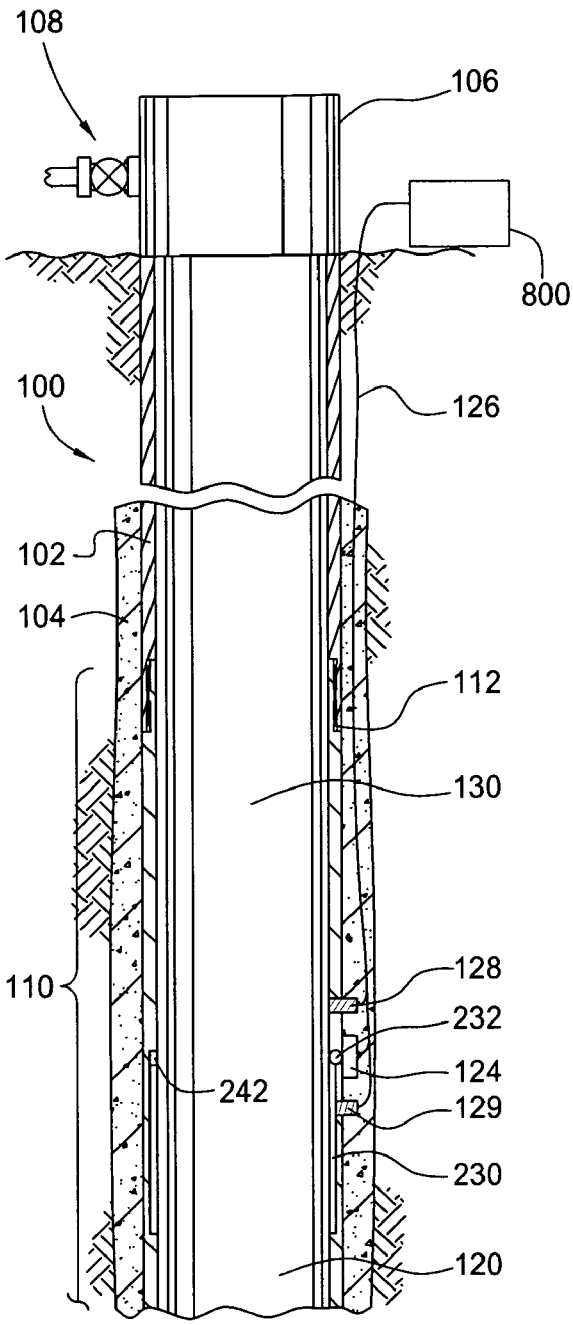
FIG. 1 is a section view of a wellbore having a casing string therein, the casing string including a downhole deployment valve (DDV).

FIG. 1 is a section view of a wellbore 100 with a casing string 102 disposed therein and held in pace by cement 104. The casing string 102 extends from a surface of the wellbore 100 where a wellhead 106 would typically be located along with some type of valve assembly 108 which controls the flow of fluid from the wellbore 100 and is schematically shown. Disposed within the casing string 102 is a downhole deployment valve (DDV) 110 that includes a housing 112, a flapper 230 having a hinge 232 at one end, and a valve seat 242 in an inner diameter of the housing 112 adjacent the flapper 230. Alternatively, the flapper 230 may be replaced by a ball (not shown). As stated herein, the DDV 110 is an integral part of the casing string 102 and is run into the wellbore 100 along with the casing string 102 prior to cementing. The housing 112 protects the components of the DDV 110 from damage during run in and cementing. Arrangement of the flapper 230 allows it to close in an upward fashion wherein pressure in a lower portion 120 of the wellbore will act to keep the flapper 230 in a closed position. The DDV 110 also includes a surface monitoring and control unit (SMCU) 800 to permit the flapper 230 to be opened and closed remotely from the surface of the well. As schematically illustrated in FIG. 1, the attachments connected to the SMCU 800 include some mechanical-type actuator 124 and a control line 126 that can carry hydraulic fluid and/or electrical currents. Clamps (not shown) can hold the control line 126 next to the casing string 102 at regular intervals to protect the control line 126.

Also shown schematically in FIG. 1 is an upper sensor 128 placed in an upper portion 130 of the wellbore and a lower sensor 129 placed in the lower portion 120 of the wellbore. The upper sensor 128 and the lower sensor 129 can determine a fluid pressure within an upper portion 130 and a lower portion 120 of the wellbore, respectively. Similar to the upper and lower sensors 128, 129 shown, additional sensors (not shown) can be located in the housing 112 of the DDV 110 to measure any wellbore condition or parameter such as a position of the sleeve 226, the presence or absence of a drill string, and wellbore temperature. The additional sensors can determine a fluid composition such as an oil to water ratio, an oil to gas ratio, or a gas to liquid ratio. Furthermore, the additional sensors can detect and measure a seismic pressure wave from a source located within the wellbore, within an adjacent wellbore, or at the surface. Therefore, the additional sensors can provide real time seismic information.

Figure 2:
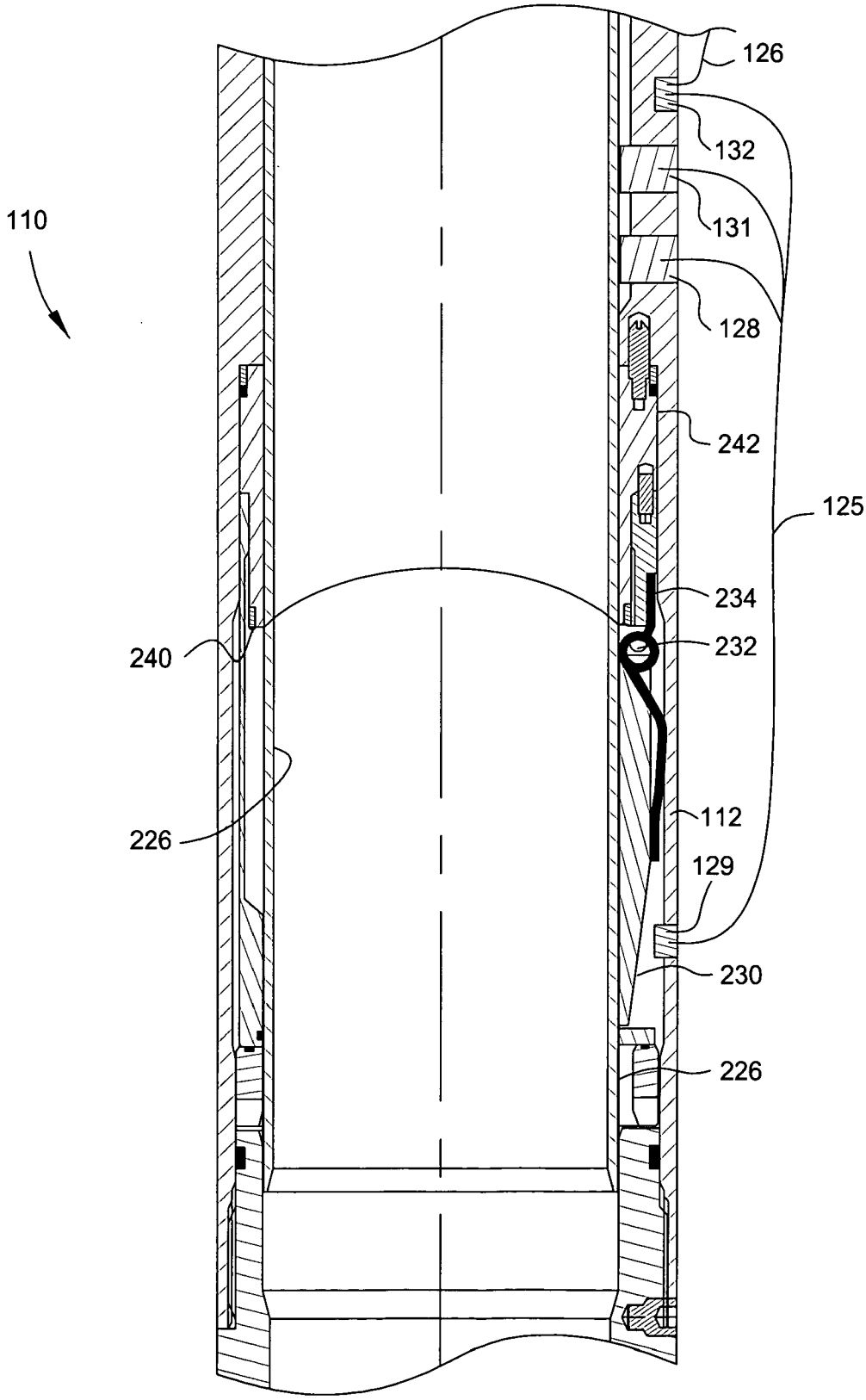
FIG. 2 is an enlarged view showing the DDV in greater detail.

FIG. 2 is an enlarged view of a portion of the DDV 110 showing the flapper 230 and a sleeve 226 that keeps it in an open position. In the embodiment shown, the flapper 230 is initially held in an open position by the sleeve 226 that extends downward to cover the flapper 230 and to ensure a substantially unobstructed bore through the DDV 110. A sensor 131 detects an axial position of the sleeve 226 as shown in FIG. 2 and sends a signal through the control line 126 to the SMCU 800 that the flapper 230 is completely open. All sensors such as the sensors 128, 129, 131 shown in FIG. 2 connect by a cable 125 to circuit boards 132 located downhole in the housing 112 of the DDV 110. Power supply to the circuit boards 132 and data transfer from the circuit boards 132 to the SMCU 800 is achieved via an electric conductor in the control line 126. Circuit boards 132 have free channels for adding new sensors depending on the need.

Figure 3:
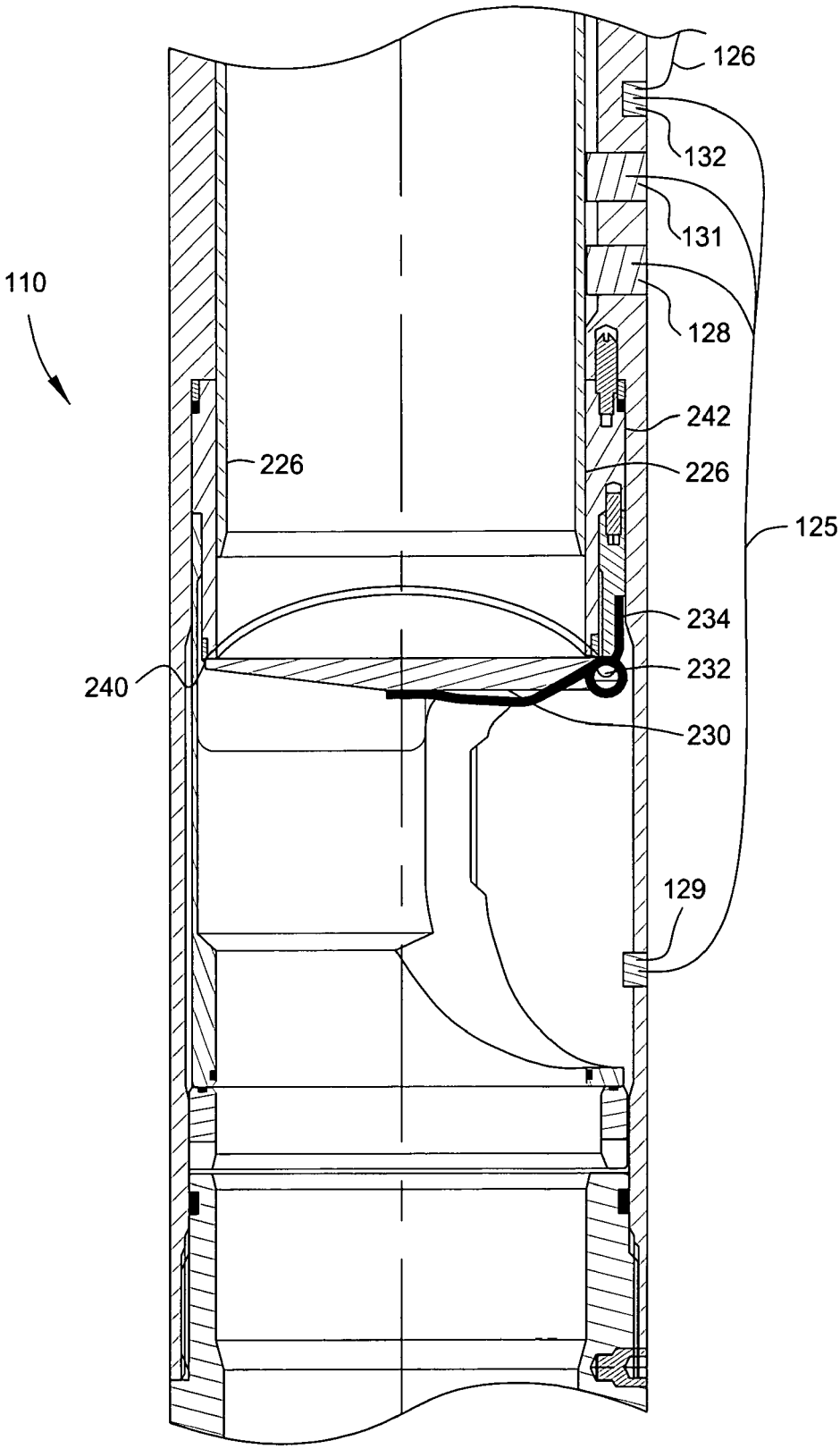
FIG. 3 is an enlarged view showing the DDV in a closed position.

FIG. 3 is a section view showing the DDV 110 in a closed position. A flapper engaging end 240 of a valve seat 242 in the housing 112 receives the flapper 230 as it closes. Once the sleeve 226 axially moves out of the way of the flapper 230 and the flapper engaging end 240 of the valve seat 242, a biasing member 234 biases the flapper 230 against the flapper engaging end 240 of the valve seat 242. In the embodiment shown, the biasing member 234 is a spring that moves the flapper 230 along an axis of a hinge 232 to the closed position. Common known methods of axially moving the sleeve 226 include hydraulic pistons (not shown) that are operated by pressure supplied from the control line 126 and interactions with the drill string based on rotational or axially movements of the drill string. The sensor 131 detects the axial position of the sleeve 226 as it is being moved axially within the DDV 110 and sends signals through the control line 126 to the SMCU 800. Therefore, the SMCU 800 reports on a display a percentage representing a partially opened or closed position of the flapper 230 based upon the position of the sleeve 226.

Figure 4:
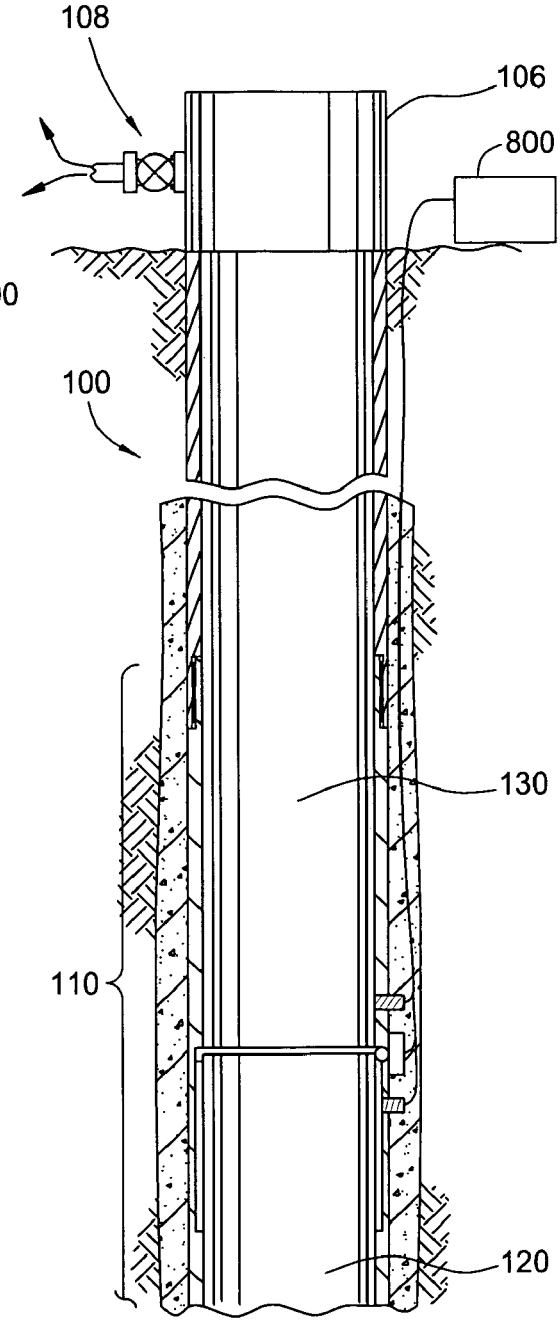
FIG. 4 is a section view of the wellbore showing the DDV in a closed position.

FIG. 4 is a section view showing the wellbore 100 with the DDV 110 in the closed position. In this position the upper portion 130 of the wellbore 100 is isolated from the lower portion 120 and any pressure remaining in the upper portion 130 can be bled out through the valve assembly 108 at the surface of the well as shown by arrows. With the upper portion 130 of the wellbore free of pressure the wellhead 106 can be opened for safely performing operations such as inserting or removing a string of tools.

Figure 5:
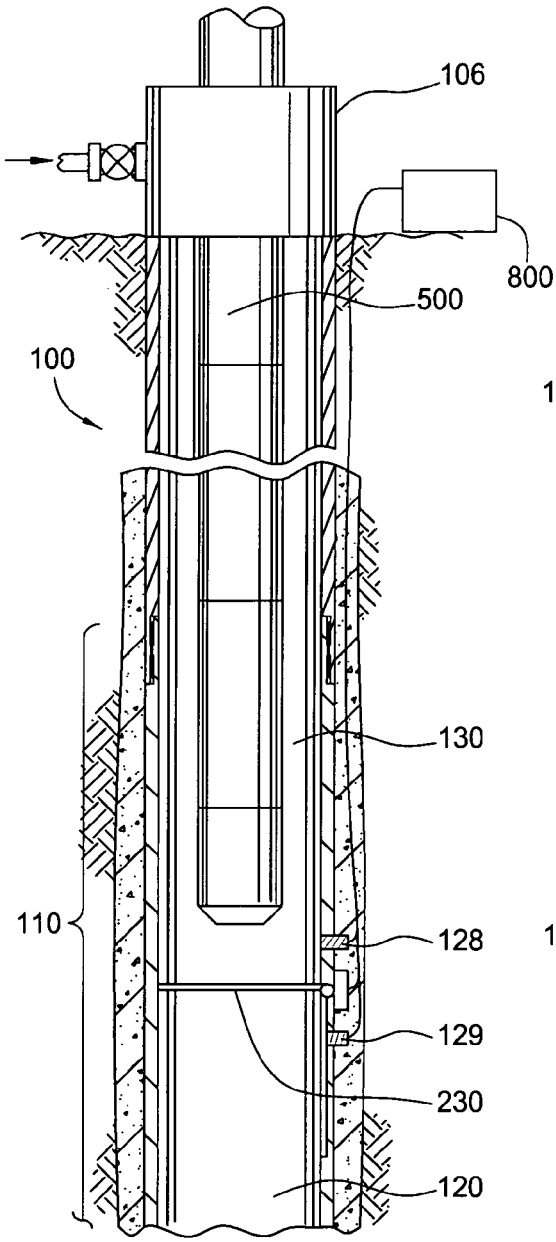
FIG. 5 is a section view of the wellbore showing a string of tools inserted into an upper portion of the wellbore with the DDV in the closed position.
Figure 6:
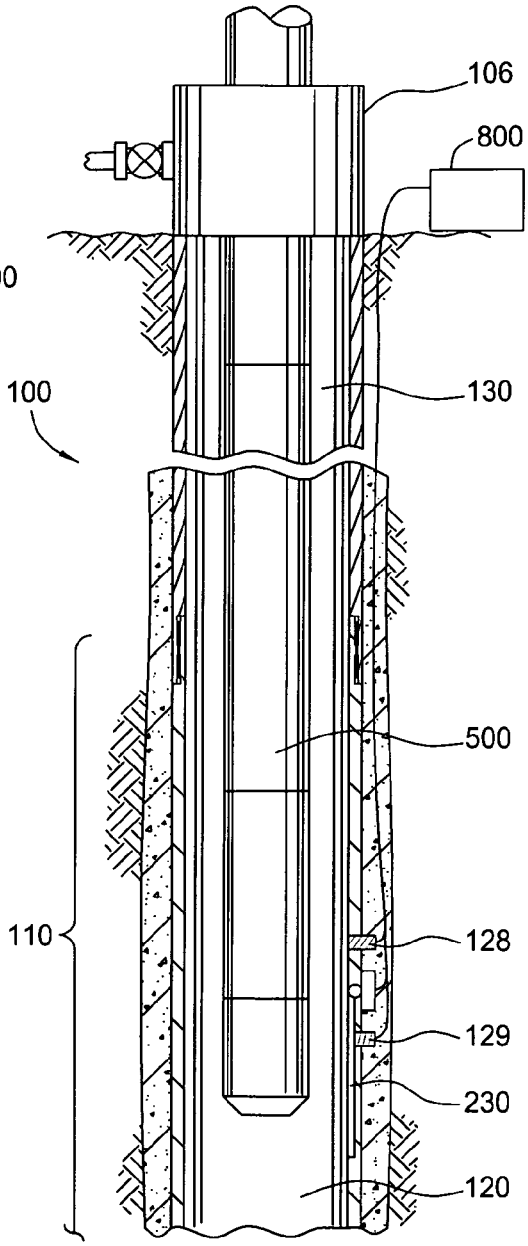
FIG. 6 is a section view of the wellbore with the string of tools inserted and the DDV opened.

FIG. 5 is a section view showing the wellbore 100 with the wellhead 106 opened and a string of tools 500 having been instated into the upper portion 130 of the wellbore. The string of tools 500 can include apparatus such as bits, mud motors, measurement while drilling devices, rotary steering devices, perforating systems, screens, and/or slotted liner systems. These are only some examples of tools that can be disposed on a string and instated into a well using the method and apparatus of the present invention. Because the height of the upper portion 130 is greater than the length of the string of tools 500, the string of tools 500 can be completely contained in the upper portion 130 while the upper portion 130 is isolated from the lower portion 120 by the DDV 110 in the closed position. Finally, FIG. 6 is an additional view of the wellbore 100 showing the DDV 110 in the open position and the string of tools 500 extending from the upper portion 130 to the lower portion 120 of the wellbore. In the illustration shown, a device (not shown) such as a stripper or rotating head at the wellhead 106 maintains pressure around the tool string 500 as it enters the wellbore 100.

Prior to opening the DDV 110, fluid pressures in the upper portion 130 and the lower portion 120 of the wellbore 100 at the flapper 230 in the DDV 110 must be equalized or nearly equalized to effectively and safely open the flapper 230. Since the upper portion 130 is opened at the surface in order to insert the tool string 500, it will be at or near atmospheric pressure while the lower portion 120 will be at well pressure. Using means well known in the art, air or fluid in the top portion 130 is pressurized mechanically to a level at or near the level of the lower portion 120. Based on data obtained from sensors 128 and 129 and the SMCU 800, the pressure conditions and differentials in the upper portion 130 and lower portion 120 of the wellbore 100 can be accurately equalized prior to opening the DDV 110.

While the instrumentation such as sensors, receivers, and circuits is shown as an integral part of the housing 112 of the DDV 110 (See FIG. 2) in the examples, it will be understood that the instrumentation could be located in a separate "instrumentation sub" located in the casing string. The instrumentation sub can be hard wired to a SMCU in a manner similar to running a hydraulic dual line control (HDLC) cable from the instrumentation of the DDV 110 (see FIG. 8). Therefore, the instrumentation sub utilizes sensors, receivers, and circuits as described herein without utilizing the other components of the DDV 110 such as a flapper and a valve seat.

Figure 8:
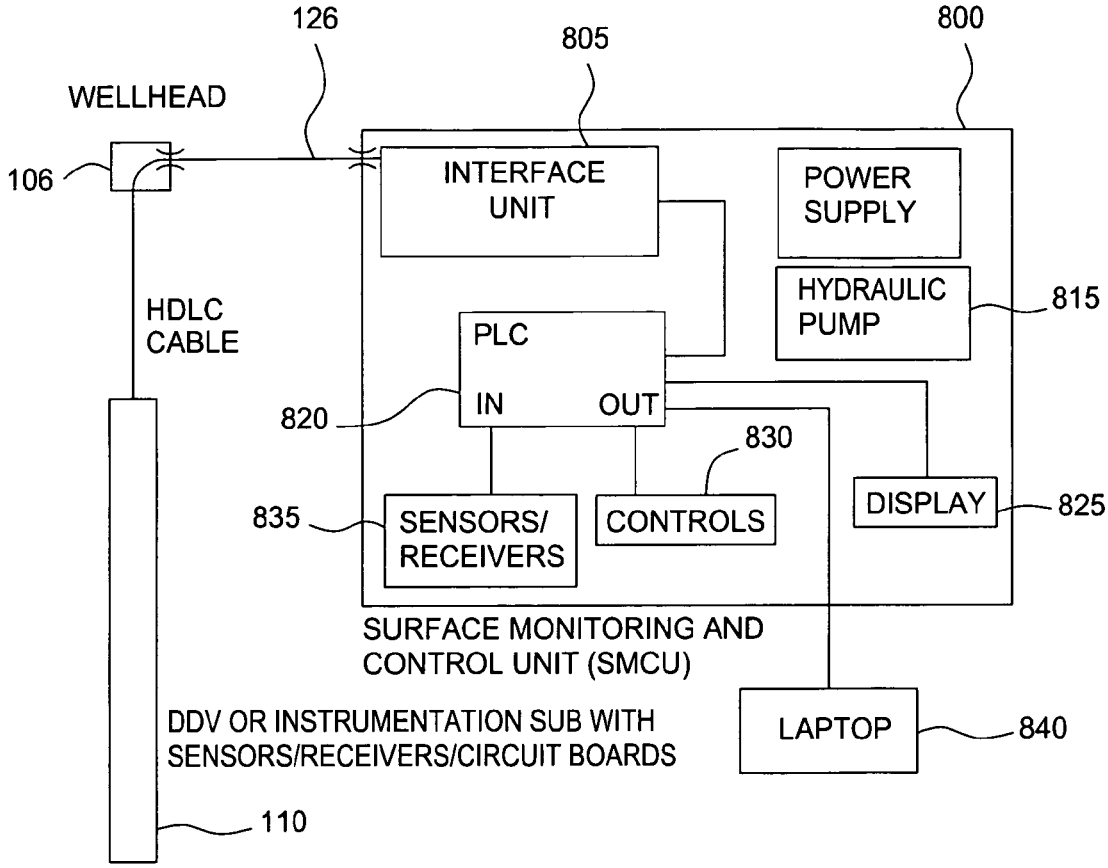
FIG. 8 is a schematic diagram of a control system and its relationship to a well having a DDV or an instrumentation sub that is wired with sensors.

FIG. 8 is a schematic diagram of a control system and its relationship to a well having a DDV or an instrumentation sub that is wired with sensors.

The figure shows the wellbore having the DDV 110 disposed therein with the electronics necessary to operate the sensors discussed above (see FIG. 1). A conductor embedded in a control line which is shown in FIG. 8 as a hydraulic dual line control (HDLC) cable 126 provides communication between downhole sensors and/or receivers 835 and a surface monitoring and control unit (SMCU) 800. The HDLC cable 126 extends from the DDV 110 outside of the casing string containing the DDV to an interface unit of the SMCU 800. The SMCU 800 can include a hydraulic pump 815 and a series of valves utilized in operating the DDV 110 by fluid communication through the HDLC 126 and in establishing a pressure above the DDV 110 substantially equivalent to the pressure below the DDV 110. In addition, the SMCU 800 can include a programmable logic controller (PLC) 820 based system for monitoring and controlling each valve and other parameters, circuitry 805 for interfacing with downhole electronics, an onboard display 825, and standard RS-232 interfaces (not shown) for connecting external devices. In this arrangement, the SMCU 800 outputs information obtained by the sensors and/or receivers 835 in the wellbore to the display 825. Using the arrangement illustrated, the pressure differential between the upper portion and the lower portion of the wellbore can be monitored and adjusted to an optimum level for opening the valve. In addition to pressure information near the DDV 110, the system can also include proximity sensors that describe the position of the sleeve in the valve that is responsible for retaining the valve in the open position. By ensuring that the sleeve is entirely in the open or the closed position, the valve can be operated more effectively. A separate computing device such as a laptop 840 can optionally be connected to the SMCU 800.

Figure 7:
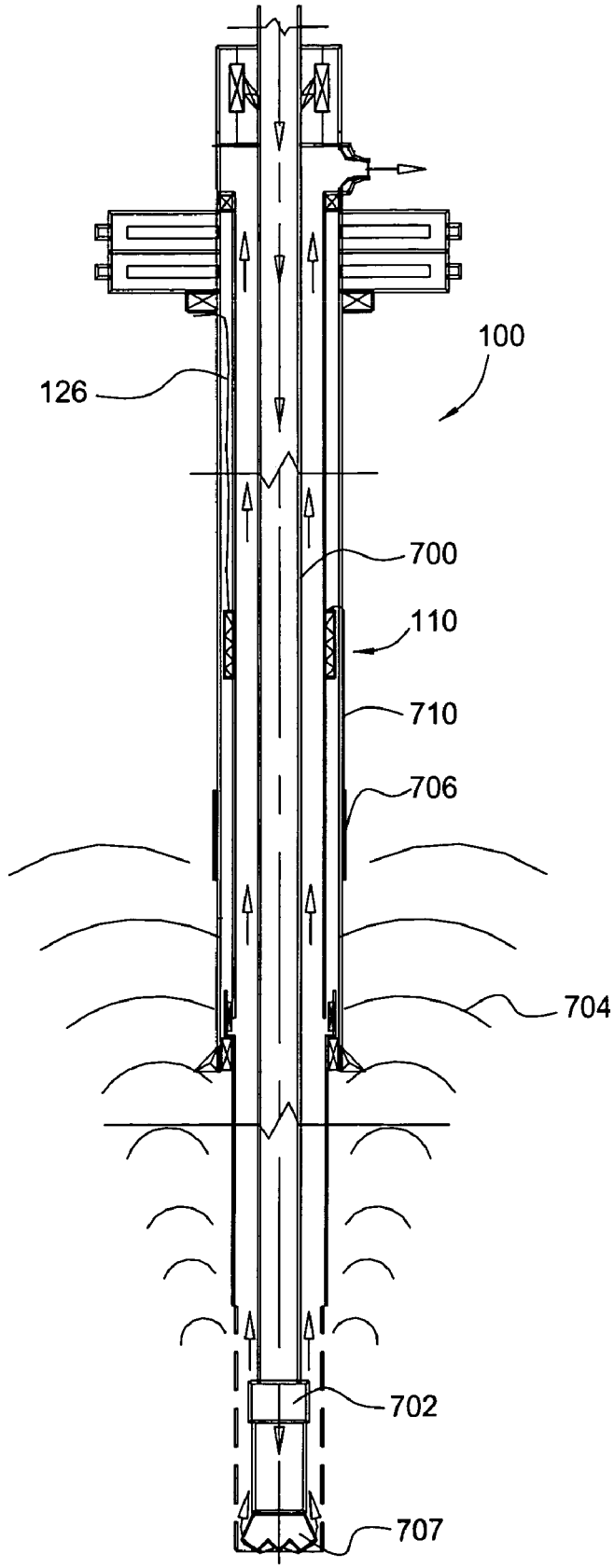
FIG. 7 is a section view of a wellbore showing the DDV of the present invention in use with a telemetry tool.

FIG. 7 is a section view of a wellbore 100 with a string of tools 700 that includes a telemetry tool 702 inserted in the wellbore 100. The telemetry tool 702 transmits the readings of instruments to a remote location by means of radio waves or other means. In the embodiment shown in FIG. 7, the telemetry tool 702 uses electromagnetic (EM) waves 704 to transmit downhole information to a remote location, in this case a receiver 706 located in or near a housing of a DDV 110 instead of at a surface of the wellbore. Alternatively, the DDV 110 can be an instrumentation sub that comprises sensors, receivers, and circuits, but does not include the other components of the DDV 110 such as a valve. The EM wave 704 can be any form of electromagnetic radiation such as radio waves, gamma rays, or x-rays. The telemetry tool 702 disposed in the tubular string 700 near the bit 707 transmits data related to the location and face angle of the bit 707, hole inclination, downhole pressure, and other variables. The receiver 706 converts the EM waves 704 that it receives from the telemetry tool 702 to an electric signal, which is fed into a circuit in the DDV 110 via a short cable 710. The signal travels to the SMCU via a conductor in a control line 126. Similarly, an electric signal from the SMCU can be sent to the DDV 110 that can then send an EM signal to the telemetry tool 702 in order to provide two way communication. By using the telemetry tool 702 in connection with the DDV 110 and its preexisting control line 126 that connects it to the SMCU 800 at the surface, the reliability and performance of the telemetry tool 702 is increased since the EM waves 704 need not be transmitted through formations as far. Therefore, embodiments of this invention provide communication with downhole devices such as telemetry tool 702 that are located below formations containing an EM barrier. Examples of downhole tools used with the telemetry tool 702 include a measurement while drilling (MWD) tool or a pressure while drilling (PWD) tool.

Still another use of the apparatus and methods of the present invention relate to the use of an expandable sand screen or ESS and real time measurement of pressure required for expanding the ESS. Using the apparatus and methods of the current invention with sensors incorporated in an expansion tool and data transmitted to a SMCU (see FIG. 8) via a control line connected to a DDV or instrumentation sub having circuit boards, sensors, and receivers within, pressure in and around the expansion tool can be monitored and adjusted from a surface of a wellbore. In operation, the DDV or instrumentation sub receives a signal similar to the signal described in FIG. 7 from the sensors incorporated in the expansion tool, processes the signal with the circuit boards, and sends data relating to pressure in and around the expansion tool to the surface through the control line. Based on the data received at the surface, an operator can adjust a pressure applied to the ESS by changing a fluid pressure supplied to the expansion tool.

While the foregoing is directed to embodiments of the present invention, other and further embodiments of the invention may be devised without departing from the basic scope thereof, and the scope thereof is determined by the claims that follow.

The invention claimed is:

1. An apparatus for use in a wellbore, comprising:

a housing defining a bore formed therein, the housing being located in the wellbore such that the bore is aligned with the wellbore;

a valve disposed within the housing and movable between an open position and a closed position, wherein the closed position substantially seals a first portion of the bore from a second portion of the bore and the open position provides a passageway to permit one or more tools lowered into the wellbore to pass through the bore;

a sensor located downhole and configured to detect whether the valve is in the open position, the closed position or a position between the open position and the closed position;

a second sensor configured to detect a presence of a drill string within the housing; and a monitoring and control unit configured to collect information provided by the sensors.

2. The apparatus of claim 1, wherein the first portion of the bore communicates with a surface of the wellbore.

3. The apparatus of claim 1, further comprising a control line connecting the sensors to the monitoring and control unit.

4. The apparatus of claim 1, wherein the monitoring and control unit controls the valve.

5. The apparatus of claim 1, wherein the monitoring and control unit monitors a pressure in the first portion of the bore.

6. The apparatus of claim 1, wherein the monitoring and control unit monitors a pressure in the second portion of the bore.

7. The apparatus of claim 1, further comprising a third sensor configured to detect a temperature at the housing.

8. The apparatus of claim 1, further comprising a third sensor configured to detect a fluid composition at the housing.

9. The apparatus of claim 1, further comprising a receiver configured to detect a signal from a transmitting downhole tool.

10. A method for transferring information between an expansion tool positioned at a first position within a wellbore and a second position, comprising:

assembling a downhole instrumentation sub as part of a first tubular string, wherein the downhole instrumentation sub comprises at least one receiver;

running the first tubular string into the wellbore;

runnning the expansion tool into the wellbore and through the first tubular string using a second tubular string;

receiving a signal from the expansion tool with the at least one receiver; and transmitting data from the downhole instrumentation sub to the second position;

measuring in real time a fluid pressure within the expansion tool and a fluid pressure around the expansion tool; and adjusting the fluid pressure within the expansion tool.

11. A method of operating a downhole deployment valve in a wellbore, comprising:

disposing the downhole deployment valve in the wellbore, the downhole deployment valve defining a bore aligned within the wellbore and having a sensor located downhole being monitored by a monitoring and control unit;

determining whether the deployment valve is in an open position, a closed position, or a position between the open position and the closed position with the sensor;

closing a valve in the downhole deployment valve to substantially seal a first portion of the bore from a second portion of the bore;

measuring a pressure differential between the first portion of the bore and the second portion of the bore with the sensor;

equalizing a pressure differential between the first portion of the bore and the second portion of the bore; and opening the valve in the downhole deployment valve.

12. The method of claim 11, wherein the first portion of the bore communicates with a surface of the wellbore.

13. The method of claim 11, wherein disposing the downhole deployment valve in the wellbore comprises connecting the downhole deployment valve to the monitoring and control unit with a control line.

14. The method of claim 11, further comprising controlling the valve with the monitoring and control unit.

15. The method of claim 11, further comprising controlling a pressure in the first portion of the bore with the monitoring and control unit.

16. The method of claim 11, further comprising lowering a pressure in the first portion of the bore to substantially atmospheric pressure.

17. The method of claim 16, further comprising inserting a string of tools into the wellbore.

18. The method of claim 11, wherein the downhole deployment valve further has a second sensor and the method further comprises determining a temperature at the downhole deployment valve with the second sensor.

19. The method of claim 11, wherein the downhole deployment valve further has a second sensor and the method further comprises determining a presence of a drill string within the downhole deployment valve with the second sensor.

20. The method of claim 11, further comprising relaying from the downhole deployment valve to a surface of the wellbore a signal received from a transmitting downhole tool.

21. A downhole deployment valve (DDV), comprising:

a housing having a fluid flow path therethrough;

a valve member operatively connected to the housing for selectively obstructing the flow path, wherein the valve member is a flapper or a ball;

a sensor for sensing a wellbore parameter or a parameter of the DDV;

a second sensor for sensing a presence of a drill string within the housing; and a hydraulic piston operable to open the valve member.

22. The DDV of claim 21, wherein the sensor is for sensing a DDV operational position.

23. The DDV of claim 21, wherein the sensor is for sensing a wellbore parameter and the wellbore parameter is selected from a group of parameters consisting of: a pressure, a temperature, and a fluid composition.

24. The DDV of claim 21, wherein the sensor is for sensing a wellbore parameter and the wellbore parameter is a seismic pressure wave.

25. The DDV of claim 21, further comprising a receiver for receiving a signal from a tool in a wellbore.

26. The DDV of claim 25, wherein the signal represents an operating parameter of the tool.

27. The DDV of claim 25, wherein the signal is a pressure wave.

28. The DDV of claim 21, wherein the valve further comprises a third sensor and the sensor and the third sensor are for sensing pressure differential across the valve member.

29. A method of using a downhole deployment valve (DDV) in a wellbore, the method comprising:

assembling the DDV as part of a casing string, the DDV comprising:

a valve member movable between an open and a closed position, an axial bore therethrough in communication with an axial bore of the casing when the valve member is in the open position, the valve member obstructing the DDV bore in the closed position, thereby substantially sealing a first potion of the casing string bore from a second portion of the casing string bore, and a pressure sensor, wherein:

the DDV bore has a diameter substantially equal to a diameter of the casing string bore, and a control line is disposed along the casing string to provide communication between the pressure sensor and a surface of the wellbore;

running the casing string into the wellbore; and cementing at least a portion of the casing string within the wellbore.

30. The method of claim 29, wherein the DDV further comprises a second sensor configured to sense a parameter of the DDV or a parameter of the wellbore.

31. The method of claim 30, wherein the second sensor is configured to sense a seismic pressure wave.

32. The method of claim 30, wherein the second sensor is configured to sense the position of the valve member.

33. The method of claim 29, wherein the DDV further comprises a receiver configured to detect a signal from a tool disposed in the wellbore.

34. The method of claim 33, wherein the signal is an electromagnetic wave.

35. The method of claim 33, further comprising:

receiving the signal from the tool with the receiver; and transmitting data from the DDV to the surface.

36. The method of claim 35, further comprising providing a monitoring/control unit (SMCU) at the surface of the wellbore, the SMCU in communication with the pressure sensor.

37. The method of claim 35, further comprising relaying the signal to a circuit operatively connected to the receiver.

38. The method of claim 35, wherein the tool is a measurement while drilling tool.

39. The method of claim 35, wherein the tool is a pressure while drilling tool.

40. The method of claim 35, wherein the tool is an expansion tool.

41. The method of claim 40, further comprising controlling an operation of the expansion tool based on the data.

42. The method of claim 40, further comprising:

measuring in real time a fluid pressure within the expansion tool and a fluid pressure around the expansion tool during an installation of an expandable sand screen; and adjusting the fluid pressure within the expansion tool.

43. The method of claim 29, wherein the DDV further comprises a second sensor and the sensors are configured to sense pressure differential across the valve member and the method further comprises:

closing the valve member to substantially seal the first portion of the casing string bore from the second portion of the casing string bore;

measuring the pressure differential across the valve member;

equalizing a pressure differential between the first portion of the casing string bore and the second portion of the casing string bore; and opening the valve member.

44. The method of claim 43, wherein the first portion of the casing string bore is in communication with a surface of the wellbore.

45. The method of claim 43, further comprising:

providing a monitoring/control unit (SMCU) at the surface of the wellbore, the SMCU in communication with the pressure sensors.

46. The method of claim 45, further comprising controlling a pressure in the first portion of the casing string bore with the SMCU.

47. The method of claim 43, further comprising lowering the pressure in the first portion of the casing string bore to substantially atmospheric pressure.

48. The method of claim 47, further comprising inserting a string of tools into the wellbore.

49. The method of claim 43, wherein the DDV further comprises a third sensor and the third sensor is configured to sense the DDV position and the method further comprises determining whether the valve is in the open position, the closed position, or a position between the open position and the closed position with the third sensor.

50. The method of claim 43, wherein the DDV further comprises a third sensor and the third sensor is configured to sense a temperature of the wellbore and the method further comprises determining a temperature at the DDV with the third sensor.

51. The method of claim 43, wherein the DDV further comprises a third sensor and the third sensor is configured to sense a presence of a drill string and the method further comprises determining a presence of the drill string within the DDV with the third sensor.

52. The method of claim 29, wherein the DDV further comprises a second sensor and the second sensor is configured to sense a presence of a drill string within the DDV.

53. The method of claim 29, further comprising running a drill string through the casing string bore and the DDV bore when the valve member is in the open position, the drill string comprising a drill bit located at an axial end thereof.

54. A method of using a downhole deployment valve (DDV) in a wellbore extending to a first depth, the method comprising:

assembling the DDV as part of a tubular string, the DDV comprising:

a valve member movable between an open and a closed position, wherein the valve member is a flapper or a ball;

an axial bore therethrough in communication with an axial bore of the tubular string when the valve member is in the open position, the valve member obstructing the DDV bore in the closed position, thereby substantially sealing a first portion of the tubular string bore from a second portion of the tubular string bore; and a sensor configured to sense a parameter of the DDV or a parameter of the wellbore, wherein a control line is disposed along the tubular string to provide communication between the sensor and a surface of the wellbore;

running the tubular string into the wellbore;

running a drill string through the tubular string bore and the DDV bore when the valve member is in the open position, the drill string comprising a drill bit located at an axial end thereof; and drilling the wellbore to a second depth using the drill string and the drill bit.

55. The method of claim 54, wherein the wellbore is drilled in an underbalanced or near underbalanced condition.

56. The method of claim 54, wherein the DDV bore has a diameter substantially equal to a diameter of the tubular string bore.

57. The method of claim 54, wherein the sensor is configured to sense a pressure, a temperature, or a fluid composition.

58. The method of claim 54, wherein the sensor is configured to sense a seismic pressure wave.

59. The method of claim 54, wherein the sensor is configured to sense the position of the valve member.

60. The method of claim 54, wherein the DDV further comprises a receiver configured to detect a signal from a tool disposed in the drillstring.

61. The method of claim 60, wherein the signal is an electromagnetic wave.

62. The method of claim 60, further comprising: receiving the signal from the tool with the receiver, and transmitting data from the DDV to the surface.

63. The method of claim 62, further comprising providing a monitoring/control unit (SMCU) at the surface of the wellbore, the SMCU in communication with the sensor.

64. The method of claim 62, further comprising relaying the signal to a circuit operatively connected to the receiver.

65. The method of claim 62, wherein the tool is a measurement while drilling tool.

66. The method of claim 62, wherein the tool is a pressure while drilling tool.

67. The method of claim 62, wherein the tool is an expansion tool.

68. The method of claim 67, further comprising controlling an operation of the expansion tool based on the data.

69. The method of claim 67, further comprising: measuring in real time a fluid pressure within the expansion tool and a fluid pressure around the expansion tool during an installation of an expandable sand screen; and adjusting the fluid pressure within the expansion tool.

70. The method of claim 54, wherein the DDV further comprises a second sensor, and the sensors are configured to sense pressure differential across the valve member.

71. The method of claim 70, wherein:

the method further comprises:

closing the valve member to substantially seal the first portion of the tubular string bore from the second portion of the tubular string bore;

measuring the pressure differential across the valve member;

equalizing a pressure differential between the first portion of the tubular string bore and the second portion of the tubular string bore; and opening the valve member.

72. The method of claim 71, wherein the first portion of the tubular string bore is in communication with a surface of the wellbore.

73. The method of claim 71, further comprising providing a monitoring/control unit (SMCU) at the surface of the wellbore, the SMCU in communication with the pressure sensors.

74. The method of claim 73, further comprising controlling a pressure in the first portion of the tubular string bore with the SMCU.

75. The method of claim 71, further comprising lowering the pressure in the first portion of the tubular string bore to substantially atmospheric pressure.

76. The method of claim 71, wherein:

the DDV further comprises a third sensor, the third sensor is configured to sense the DDV position, and the method further comprises determining whether the valve member is in the open position, the closed position, or a position between the open position and the closed position with the third sensor.

77. The method of claim 71, wherein:

the DDV further comprises a third sensor, the third sensor is configured to sense a temperature of the wellbore, and the method further comprises determining a temperature at the downhole deployment valve with the third sensor.

78. The method of claim 71, wherein:

the DDV further comprises a third sensor, the third sensor is configured to sense the presence of the drill string, and the method further comprises determining a presence of the drill string within the DDV bore with the third sensor.

79. The method of claim 54, wherein the DDV further comprises a second sensor and the second sensor is configured to sense a presence of a drill string within the DDV.

80. The method of claim 54, wherein the DDV is located at a depth of at least ninety feet in the wellbore.

81. The method of claim 54, wherein the sensor is configured to sense a parameter of the wellbore and the method further comprises sensing the wellbore parameter with the sensor while drilling the wellbore to the second depth.

82. The method of claim 54, further comprising injecting drilling fluid through the drill string while drilling the wellbore to the second depth, wherein the drilling fluid returns from the drill bit through the tubular string and the DDV further comprises a second sensor configured to measure a fluid composition of the drilling fluid.

83. The method of claim 54, further comprising cementing the tubular string to the wellbore.

84. A method of using a downhole deployment valve (DDV) in a wellbore, the method comprising:

assembling the DDV as pad of a casing string, the DDV comprising:

a valve member movable between an open and a closed position, an axial bore therethrough in communication with an axial bore of the casing when the valve member is in the open position, the valve member substantially sealing a first potion of the casing string bore from a second portion of the casing string bore when the valve member is in the closed position, and a pressure sensor;

running the casing string into the wellbore; and cementing at least a portion of the casing string within the wellbore;

running a drill string through the casing string bore and the DDV bore when the valve member is in the open position, the drill string comprising a drill bit located at an axial end thereof;

drilling the wellbore to a second depth using the drill string and the drill bit; and measuring a pressure of the wellbore while drilling using the pressure sensor.

85. The method of claim 10, wherein measuring the fluid pressure occurs during an installation of an expandable sand screen.

86. The method of claim 10, wherein the instrumentation sub further comprises a downhole deployment valve (DDV), the DDV comprising:

a valve member movable between an open and a closed position; and an axial bore therethrough in communication with an axial bore of the first tubular string when the valve member is in the open position, the valve member obstructing the DDV bore in the closed position, thereby substantially sealing a first portion of the first tubular string bore from a second portion of the first tubular string bore.

87. The method of claim 10, further comprising providing a monitoring/control unit (SMCU) at a surface of the wellbore, the SMCU in communication with the DDV, wherein assembling the DDV as part of the first tubular string comprises disposing a control line along the tubular string to provide communication between the DDV and the SMCU and the second position is the surface.

88. A method for drilling a wellbore, the method comprising:

assembling a downhole deployment valve (DDV) as part of a tubular string, the DDV comprising:

a valve member movable between an open and a closed position;

an axial bore therethrough in communication with an axial bore of the tubular string when the valve member is in the open position, the valve member obstructing the DDV bore in the closed position, thereby substantially sealing an upper portion of the tubular string bore from a lower portion of the tubular string bore;

an upper pressure sensor in communication with the upper portion of the tubular string bore, and a lower pressure sensor in communication with the lower portion of the tubular string bore;

running the tubular string into the wellbore so that the tubular string extends from a wellhead located at a surface of the wellbore, wherein the wellhead comprises a rotating drilling head (RDH) or a stripper and a valve assembly;

running a drill string through the tubular string bore and the DDV bore, the drill string comprising a drill bit located at an axial end thereof;

engaging the RDH or stripper with the drill string; and drilling the welibore using the valve assembly to control flow of fluid from the wellbore.

89. The method of claim 88, wherein the DDV is located at a depth in the wellbore of at least 90 feet from the surface.

90. The method of claim 88, wherein the wellbore is drilled in an underbalanced or near underbalanced condition.

91. The method of claim 88, further comprising:

retracting the drill string to a location above the DDV;

closing the DDV;

depressurizing the upper portion of the tubular string bore; and removing the drill string from the wellbore.

92. The method of claim 88, wherein the valve member is a flapper or a ball.

93. The method of claim 88, further comprising measuring a pressure of the wellbore while drilling using at least one of the pressure sensors.

94. The method of claim 88, wherein a control line is disposed along the tubular string to provide communication between the pressure sensors and the surface of the wellbore.

95. A downhole deployment valve (DDV), comprising:

a housing having a fluid flow path therethrough;

a valve member operatively connected to the housing for selectively obstructing the flow path, wherein the valve member is a flapper or a ball;

a sensor for sensing pressure differential across the valve member;

a second sensor for sensing a presence of a drill string within the housing; and a third sensor for sensing pressure differential across the valve member.

* * * * *

UNITED STATES PATENT AND TRADEMARK OFFICE

CERTIFICATE OF CORRECTION

PATENT NO. : 7,350,590 B2
APPLICATION NO. : 10/288229
DATED : April 1, 2008
INVENTOR(S) : Hosie et al.

It is certified that error appears in the above-identified patent and that said Letters Patent is hereby corrected as shown below:

On the Title Page,

In the References Cited (56):

Please delete "2,290,406 A 7/1942 Crites" and insert --2,290,408 A 7/1942 Crites--;

Please delete "6,644,110 B1* 11/2003 Spriggs et al. ..... 73/152.51" and insert --6,644,110 B1* 11/2003 Curtis et al. ..... 73/152.51 --;

Please delete "2006/0065402 A9* 3/2006 Fontanan et al. ..... 166/358" and insert --2006/0065402 A9* 3/2006 Fontana et al. ..... 166/358--;

In the Claims:

Column 9, Claim 10, Line 1, please delete "runnning" and insert --running--;

Column 14, Claim 84, Line 3, please delete "pad" and insert --part--;

Column 14, Claim 84, Line 10, please delete "potion" and insert --portion--;

Column 14, Claim 84, Line 14, please delete "and";

Column 15, Claim 88, Line 8, please delete "welibore" and insert --wellbore--.

Signed and Sealed this

Twenty-first Day of October, 2008

JON W. DUDAS
*Director of the United States Patent and Trademark Office*